US005473310A

United States Patent [19]

Ko

[11] Patent Number: 5,473,310

[45] Date of Patent: Dec. 5, 1995

[54] POOL GUARD ALARM

[76] Inventor: Joseph Y. Ko, 12 Morning Dove, Laguna Niguel, Calif. 92677

[21] Appl. No.: 404,359

[22] Filed: Mar. 15, 1995

[51] Int. Cl.[6] ..... G08B 13/08

[52] U.S. Cl. ..... 340/547; 340/309.15; 340/529; 340/540; 340/573

[58] Field of Search ..... 340/547, 529, 340/540, 545, 309.15, 573

[56] References Cited

U.S. PATENT DOCUMENTS 4,335,376 6/1982 Marquardt ..... 340/547
4,851,814 7/1989 Rehberg ..... 340/547
4,920,333 4/1990 Barr et al. ..... 340/545
5,289,534 2/1994 Lester et al. ..... 340/545

*Primary Examiner*—Glen Swann
*Attorney, Agent, or Firm*—Knobbe, Martens, Olson & Bear

[57] ABSTRACT

A pool guard alarm provides constant security at the entrance to a pool using a delayed alarm to allow access to the pool area by authorized persons. Younger, unsupervised children are indicated by the alarm since a reset button located at least 5 feet above the ground must be pressed within 10 seconds of the opening of the gate or door. The alarm is battery-operated and cannot be turned off. A magnetic sensor is used to detect entrance to the indoor or outdoor pool area.

5 Claims, 3 Drawing Sheets

POOL GUARD ALARM

BACKGROUND OF THE INVENTION

The pool guard alarm of the present invention relates generally to the field of gate alarms, and, in particular, to a gate or door alarm for use at a pool to ensure younger children do not access the pool area without proper supervision.

Prior methods of pool security, when there is no lifeguard or other supervision present, rely upon the use of locks. Only adults or older children were given the keys to open the locks for entrance to the pool area. Problems arise, however, from misplaced keys and the inventory control required to account for every key. Also, the gate or door may remain open after authorized passage, thereby allowing unauthorized use or entry by small, unattended children. The use of an electronic system is generally not advisable in a pool area, since an electric power source in close proximity to water is a dangerous combination.

In view of the foregoing, a need exists for an improved pool security device that overcomes the problems mentioned.

SUMMARY OF THE INVENTION

The pool guard alarm of the present invention overcomes the aforenoted disadvantages by its operation from a battery without need for a separate key for disarming. The alarm constructed in accordance with the present invention is applicable to both indoor and outdoor pool areas. And, complying with pool safety regulations that security be permanently operative—i.e., locks always engaged except during authorized passage therethrough—the pool guard alarm is never turned off.

A magnetic switch is used to indicate when the gate or door is opened. A reset or delay button must be pressed within a short time after opening and passage through, or a an alarm is sounded whether or not the gate or door was closed. Preferably, a delay of 10 seconds is allowed before a deafening signal of at least 110 decibels (db) is emitted. The signal also occurs if the gate/door is not closed within 10 seconds of its opening.

Also, the main body or alarm housing is preferably mounted at least 5 feet high on the fence or wall adjacent the gate or door so that young children, most likely to be endangered if unsupervised, cannot easily reach the alarm. The housing is also preferred to be of a plastic that is ultraviolet and water resistant, to ensure proper, long-lived operation in wet and/or outdoor conditions. Plastic spacers are used to mount the magnet and switch on an iron gate and fence, respectively, so that sensor operation is not affected by direct contact with the metal.

Further advantages and applications will become apparent to those skilled in the art from the following detailed description and the drawings referenced herein.

DETAILED DESCRIPTION OF THE PREFERRED EMBODIMENT

Figure 1:
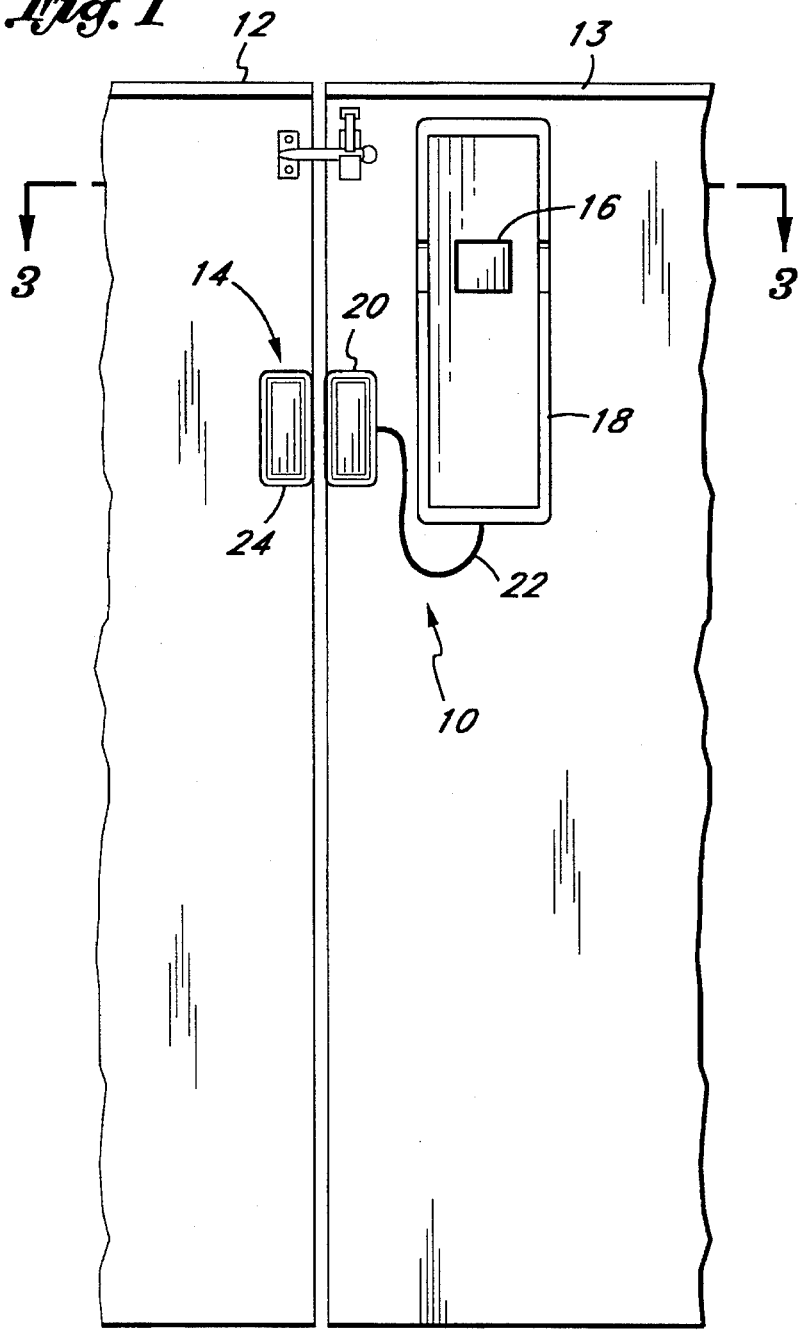
FIG. 1 is a front plan view of a preferred embodiment of a pool guard alarm constructed in accordance with the present invention, illustrating its application to a wooden gate and fence.

A pool guard alarm 10 constructed in accordance with the present invention is shown in FIG. 1 as mounted to a wood gate 12 and fence 13. Although the alarm 10 utilizes a magnetic sensor 14, it may also be applied to a metal fence, such as wrought iron, by a simple adaptation, described below. The pool guard alarm 10 is applicable for use in both indoor and outdoor pool areas, and ensures that only authorized persons, generally adults or older children, gain access without activating the alarm.

Safety regulations around swimming pools require that security means are not deactivated. Usually, this means that locks are always functional, with keys required for entrance. However, disadvantages include the need for inventory control of keys, which are easily lost. Also, gates or doors may not be closed after passage through by an adult or children, or it may be propped open or otherwise kept from fully closing. Thus, unattended children may gain entry to the pool area, which often is not supervised by a lifeguard.

An alarm constructed in accordance with the present invention overcomes these disadvantages and includes a reset delay button 16 positioned at a high enough level that smaller children cannot reach it, such as at least 5' high, even if they have learned its function. In the embodiment of FIG. 1, a main housing or body 18 of the pool guard alarm 10 is mounted near the top of the fence 13, adjacent a magnetic switch 20, which is connected via a 6" wire 22. The switch 20 in combination with a magnet 24 mounted on the gate 12 comprises an entry/exit sensor 14 whose status is transmitted to the alarm circuit in the main body 18 via the wire 22. The switch 20 and magnet 24 are substantially aligned across the opening between the gate 12 and fence 13.

Figure 3:
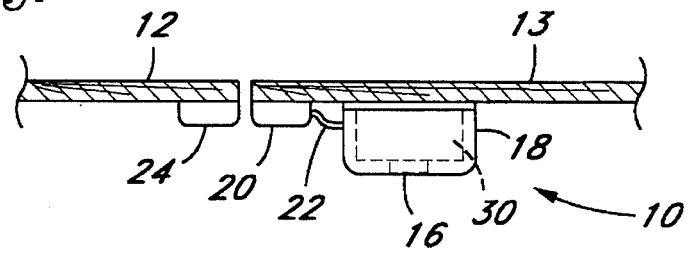
FIG. 3 is a cross-sectional view of the alarm, gate, and fence taken along lines 3—3 in FIG. 1, illustrating the main housing and a top end view of the sensor components.
Figure 2:
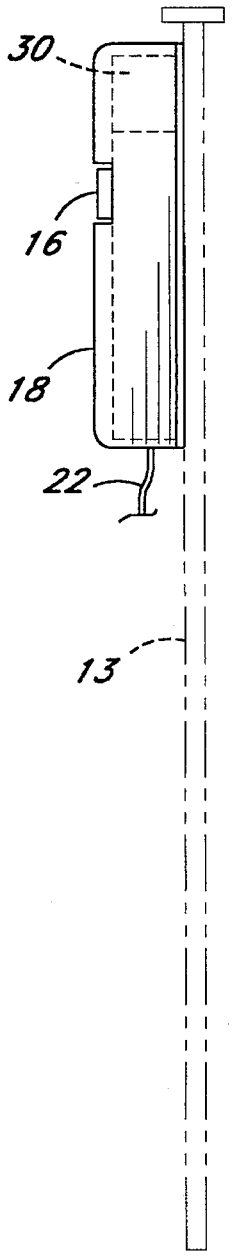
FIG. 2 is a side elevational view of the main housing of the embodiment of FIG. 1, illustrating the recessed reset button at the front of the housing.

In order to withstand the moist and hot environments of the swimming pool area, the body 18 is preferably comprised of an ultra-violet and waterproof plastic. The contents of the body 18 include a high output alarm unit 26 and a battery 28, preferably a 9 volt, electrically coupling it with the magnetic sensor 14. As illustrated in FIGS. 2 and 3, the button 16 is preferably located on the body 18 such that the front surface is relatively even. A compartment for the battery 30 (illustrated in phantom) is located in the upper portion of the body 18. Adhesive strips, or, alternately, screws, are utilized to mount the pool guard alarm 10 to the gate 12 and fence 13.

Figure 4:
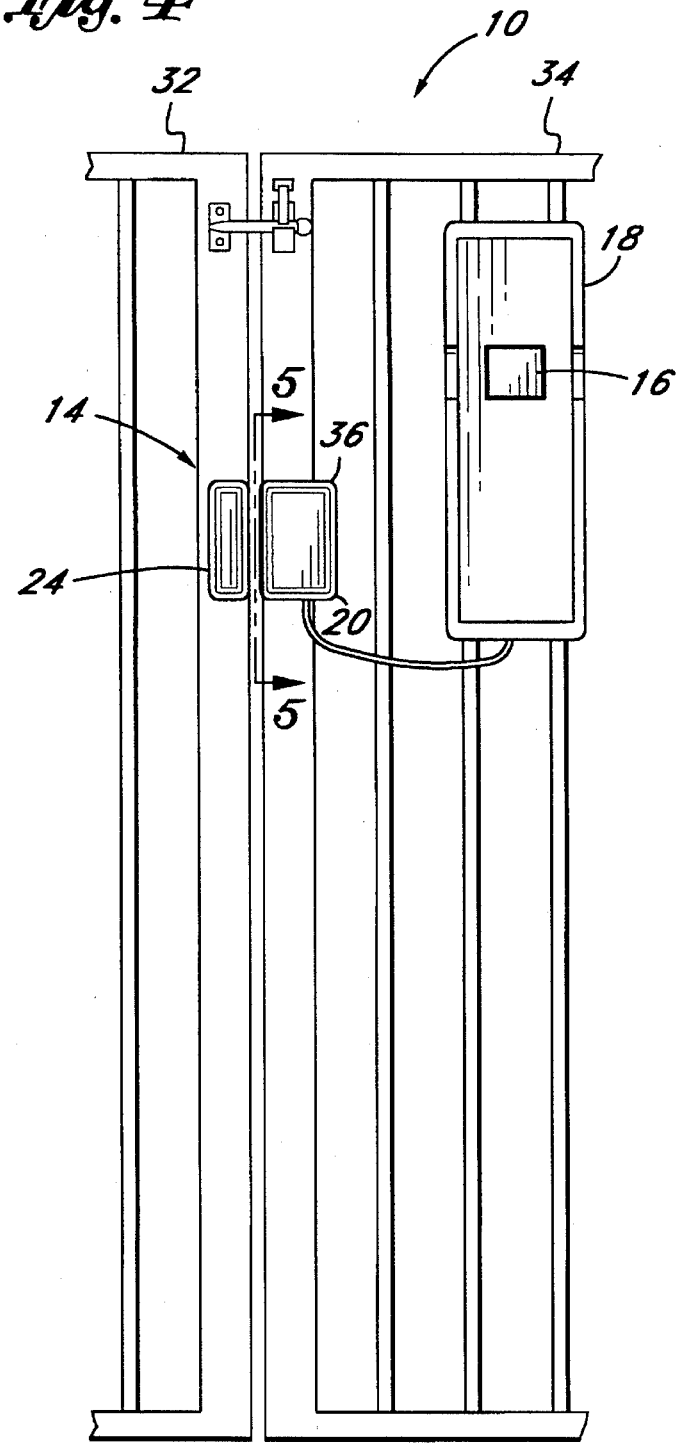
FIG. 4 is a front plan view of an alternate embodiment of a pool guard of the present invention, illustrating its application to an iron gate and fence.
Figure 5:
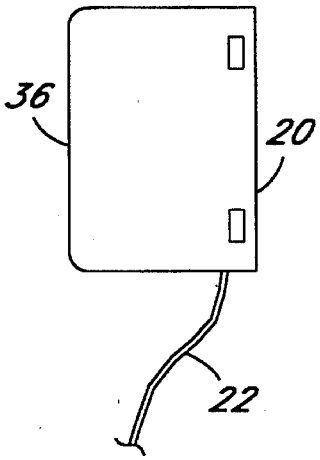
FIG. 5 is a side elevational view of the magnetic switch taken along lines 5—5 in FIG. 4, illustrating the plastic housing used to space the switch from the iron fence.

An alternate embodiment illustrating the use of the pool guard alarm 10 with an iron gate 32 and fence 34 is shown in FIG. 4. Here, a plastic housing or spacer 36, illustrated in FIG. 5, is used to provide a barrier between the magnetic sensor 14 and the iron and remove the sensor 14 from direct contact with the iron bars so that the sensor's operation is not compromised by the metal. Again, adhesive pads, screws, and/or mounting brackets may be utilized to mount the main body 18 and sensor components 20, 22, 24 to the iron gate 32 and fence 34.

Figure 6:
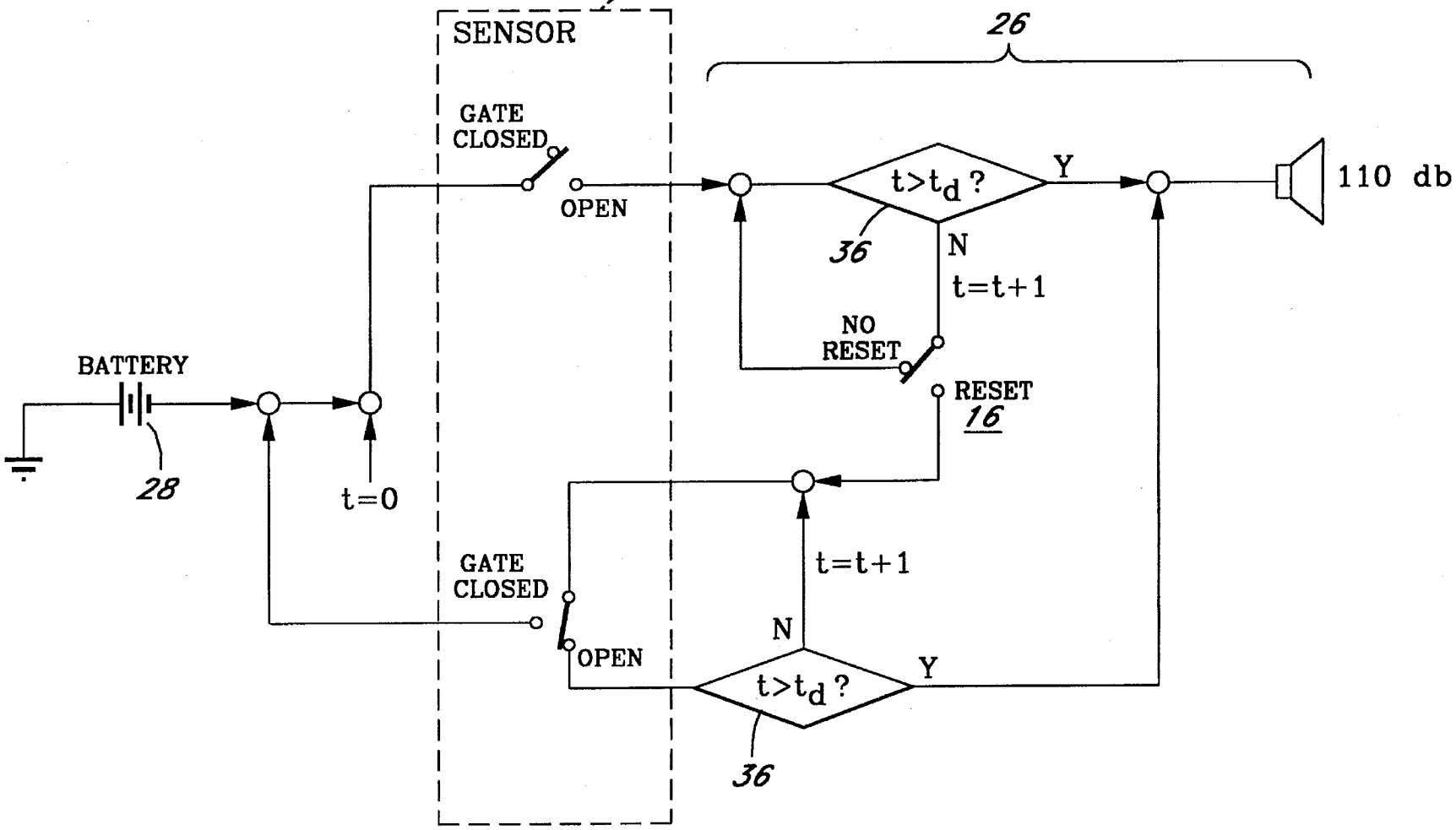
FIG. 6 is a simplified schematic of the preferred embodiment of the pool guard alarm, illustrating the time delay for deactivation of the alarm after the opening of the gate and for ensuring the gate is closed within that time.

The operation of the pool guard alarm 10 is illustrated in a simplified schematic of FIG. 6. Upon opening of the gate 12/32, the magnetic field between the magnet 24 and switch 20 of the sensor 14 is broken, which toggles a switch in the alarm circuit to indicate entry/exit. A timing mechanism 36 measures the elapsed time, t, before the reset button 16 is depressed. If a certain allowable delay time, $t_d$, preferably 10 seconds, passes without reset, then an alarm signal of approximately 110 decibels (db) is sounded. The timing mechanism 36 may be of a quartz or simple counter type known to those of ordinary skill in the art.

Also, in the alarm 10 of the present invention, the restoration of the magnetic field between the magnet 24 and switch 20 is detected, indicating the complete closure of the gate 12/32. If the sensor 14 does not detect this closure, then the time t is continued to be measured and compared to the allowed time $t_d$ for activation of the alarm. That is, if the gate 12/32 is not opened and closed within 10 seconds whether or not the reset button 16 has been depressed, the alarm is sounded. Thus, this prevents the gate 12/32 from being propped or held open for others.

The embodiments illustrated and described above are provided merely as examples of the pool guard alarm of the present invention. Other changes and modifications may be made from the embodiment presented herein by those skilled in the art without departure from the spirit and scope of the invention, as defined by the appended claims.

What is claimed is:

1. An alarm for securing an indoor or outdoor area around a pool, comprising:

a sensor for detecting entrance to the pool area, said sensor including a magnet and a magnetic switch;

a high output alarm unit operated from a battery power source and including a delay timer; and a housing containing said alarm unit, said battery, and a reset button;

wherein said housing and said sensor are mounted at the entrance to the pool area, whereby said alarm unit is activated if said reset button is not depressed within a predetermined time measured by said timer after the opening of the door or gate whether or not the door or gate is closed within said predetermined time.

2. The alarm of claim 1, wherein said housing is comprised of ultraviolet and water resistant plastic.

3. The alarm of claim 1, wherein said battery is a 9 Volt battery.

4. The alarm of claim 1, further comprising a plastic mounting member for attachment of said sensor to metal.

5. The alarm of claim 1, wherein said predetermined time is about 10 seconds.

* * * * *